United States Patent [19]

Tsuzuki

[11] Patent Number: 4,457,098

[45] Date of Patent: Jul. 3, 1984

[54] VARIABLE SPEED VEHICLE WITH SATELLITE VEHICLE

[75] Inventor: Akio Tsuzuki, Tokyo, Japan

[73] Assignee: Tomy Kogyo Co., Inc., Japan

[21] Appl. No.: 415,325

[22] Filed: Sep. 7, 1982

[51] Int. Cl.[3] ..... A63H 18/16

[52] U.S. Cl. ..... 446/435; 446/440

[58] Field of Search ..... 46/201, 202, 206, 104, 46/123, 141, 119

[56] References Cited

U.S. PATENT DOCUMENTS

| | | | |
|---|---|---|---|
| 2,414,179 | 1/1947 | Thomas | 46/119 X |
| 2,463,355 | 3/1949 | Buchmann | 46/119 |
| 2,607,163 | 8/1952 | Lohr | 46/206 |
| 2,795,081 | 6/1957 | Cavanagh | 46/103 |
| 2,803,921 | 8/1957 | Garcia-Galiano | 46/202 X |
| 3,529,479 | 9/1970 | Ryan et al. | 46/206 X |
| 3,688,435 | 9/1972 | Sapkus et al. | 46/119 |
| 3,738,054 | 6/1973 | Petrusek | 46/141 |
| 4,068,401 | 1/1978 | Saitoh | 46/92 |
| 4,114,310 | 9/1978 | Saitoh | 46/141 |

FOREIGN PATENT DOCUMENTS

| | | | |
|---|---|---|---|
| 1116992 | 5/1956 | France | 46/141 |
| 227103 | 12/1924 | United Kingdom | 46/206 |
| 2039455 | 8/1980 | United Kingdom | 46/119 |

*Primary Examiner*—Robert E. Bagwill

*Assistant Examiner*—Danton DeMille

*Attorney, Agent, or Firm*—K. H. Boswell; Edward D. O'Brian

[57] ABSTRACT

A variable speed vehicle has a satellite vehicle attached thereto by a connecting member. The variable speed vehicle includes a spring activated motor and a power train which is capable of receiving power from the motor and driving the vehicle at at least two velocities. The connecting member is fixedly attached to the satellite vehicle and movable with respect to the primary vehicle. When the satellite vehicle is moved away from the primary vehicle, the connecting member activates the spring motor, and when so activated, the spring motor returns the satellite vehicle towards the primary vehicle by acting on the connecting member. A velocity governing device is operatively associated with the power train and is responsive to the position of the satellite vehicle with respect to the primary vehicle. When the satellite vehicle has been moved away from the primary vehicle and is being returned thereto by the connecting member, the velocity governing device senses its position, and in response thereto the power train moves the primary vehicle at a first velocity, and when the satellite vehicle has been returned to the primary vehicle by the connecting member, the governing device senses its position and causes the power train to move the primary vehicle at a second velocity.

9 Claims, 10 Drawing Figures

VARIABLE SPEED VEHICLE WITH SATELLITE VEHICLE

BACKGROUND OF THE INVENTION

This invention is directed to a toy having a primary vehicle and a satellite attached thereto which can be extended from the primary vehicle and which, in so doing, activates a motor in the primary vehicle which returns the satellite to the primary vehicle. The activated motor drives the primary vehicle at a first velocity when the satellite is extended away from the primary vehicle and at a second velocity when the satellite has been returned to the primary vehicle.

A class of toys exist which are exemplified by U.S. Pat. Nos. 2,795,081; 4,114,310; 4,068,401 and 2,803,921. This class of toys is directed to toys which have a main component part and at least one auxiliary, or satellite, component part attached thereto by a tether, string, or the like. Additionally, U.S. Pat. No. 3,688,435 describes a hand-holdable device wherein a satellite object is made to extend from and return to the device by manipulation of certain component parts of the device. While the device of the patent listed in the previous sentence is related to this invention, the devices described in the other patents previously listed are more closely related.

In U.S. Pat. No. 2,795,081, a mother duck is pulled by a string. Connecting to the mother duck is a tether which includes two ducklings attached thereto. As the mother duck is pulled along, the tether attached to the ducklings is first retracted into the mother duck, bringing the ducklings closer to the mother duck, and then allowed to extend out of the mother duck, allowing the ducklings to fall farther behind the mother duck. This is accomplished by having a belt drive connecting between a set of front and back wheels in the mother duck with a portion of the belt drive being thicker than the remaining portion such that the thicker portion contacts a spindle to wind the ducklings toward the mother duck during one half of the rotation of the belt, and then disengages with the spindle for the remainder of the rotation of the belt, at which time the spindle is no longer rotated within the mother duck, allowing the tether to be extracted by the mass of the ducklings pulling on it.

U.S. Pat. No. 2,803,921 describes a toy which also has an auxiliary body attached to a driving body. Located within the driving body is a spool to which the tether is attached. As the driving body moves forward, the spool is wound, bringing the auxiliary body in contact with the driving body. The auxiliary body has the capacity to open up, giving the impression of swallowing the driving body. When the driving body becomes located within the interior of the auxiliary body, winding of the tether on the spool ceases, and movement of the driving body ceases. Since the driving body has become located within the auxiliary body and is no longer in contact with the support surface, the toy ceases all movement with respect to the driving surface as soon as the driving body becomes located within the auxiliary body.

U.S. Pat. No. 4,068,401 utilizes a principle very similar to U.S. Pat. No. 2,803,921. The difference between these two patents is that U.S. Pat. No. 4,068,401 is directed to an aquatic vehicle, which, instead of being propelled along a support surface by driving wheels and the like, utilizes appropriate movement of a pivotable tail, pivotable paddles, or the like, to propel the driving body in an aquatic environment. A further difference between this patent and U.S. Pat. No. 2,803,921 is that it is the body capable of containing the other body that has the driving means located therein. U.S. Pat. No. 4,068,401 has in common with U.S. Pat. No. 2,083,921 the fact that once the one body is located in the other body, all movement of both bodies ceases and the toy remains static.

U.S. Pat. No. 4,114,310 is closely related to the patents mentioned above. It differs from U.S. Pat. No. 4,068,401 in that it is a land vehicle capable of moving over a solid support surface by driving wheels and the like. As with the patents mentioned in the previous paragraph, one of the two bodies of this patent is capable of containing the other of the bodies. This patent contains a feature extracted from both of the patents noted in the previous paragraphs in that, in one embodiment, it is the driven member which ultimately contains the driving member in its interior, and in another embodiment it is the driving member that ultimately contains the driven member in its interior. As with the devices mentioned in the previous paragraph, once one of the members is located in the other of the members, all movement of both members ceases and the toy remains static.

While it is considered that the toys noted in the above noted patents all have considerable play value, as was pointed out with regard to U.S. Pat. No. 4,114,310, U.S. Pat. No. 4,068,401 and U.S. Pat. No. 2,803,921, once one of the bodies has become located in the other of the bodies, action of the toys described therein ceases, and the toy remains static and inanimate. It is considered that while all of the toys of the above noted patents have a compelling feature in that one body moves with respect to another body, there exists a need for a toy which includes this feature, but also includes an additional feature wherein the toy does not remain static and inanimate after association of the two bodies, but continues in action mode.

BRIEF DESCRIPTION OF THE INVENTION

In view of the above, it is a broad object of this invention to provide a toy which has a main, or primary, body and an auxiliary body connected thereto, with the feature that movement of the auxiliary body away from the primary body activates the toy, and once so activated, the auxiliary body becomes reassociated with the primary body, and after reassociation, both bodies maintain some mode of action for a subsequent period of time. It is a further object of this invention to provide a toy of the preceding sentence which, because of its engineering principles and play value, is capable of being constructed in such a manner that the toy is capable of a long useful lifetime by its owner, and during this lifetime will provide entertaining play value during its use.

These and other objects, as will become evident from the remainder of this specification are achieved in a toy which comprises: a first body; said first body including a spring activated motor means; said first body including a variable velocity moving means operatively associated with and receiving power from said motor means and capable of moving said first body at least two velocities with respect to the support medium; a second body associated with said first body; a connecting means fixedly attached to said second body and movably associated with said first body motor means whereby movement of said second body away from said first body from a proximal position to a distal position moves said connecting means with respect to said motor means activating said motor means, and when so activated said motor means interacting with said connecting means by moving said connecting means and in response to said movement of said connecting means said second body being moved from said distal position towards said first body to said proximal position; velocity governing means operatively associated with said moving means and operatively responsive to the position of said second body with respect to said first body whereby after said second body has been moved from said proximal position away from said first body to said distal position said moving means in association with said governing means moving said first body at one of said velocities and when said second body is moved from said distal position towards said first body to said proximal position in response to interaction of said motor means with said connecting means said moving means in association with said governing means moving said first body at a second velocity.

In the illustrative embodiment of the invention herein, wherein said second body is in said proximal position, said first body would be capable of holding said second body and transporting said second body in conjunction with said first body with respect to the support medium.

In the preferred embodiment of the invention, the moving means would further include a fly wheel means capable of being energized as the first body moves at one of the velocities, and when so energized, would be capable of moving the first body at a second velocity including transporting the second body by the first body at said second velocity.

The velocity governing means would preferredly include a second body sensing means located on the first body and capable of sensing when the second body is in the distal position and when it is in the proximal position.

Preferredly, the first body would comprise a first vehicle and would include at least one drive wheel located on this vehicle. The moving means would preferredly comprise a gear train means associated with the drive wheel, the motor means and the fly wheel means. The gear train means would be capable of propagating power from the motor to both the drive wheel and the fly wheel means in a first instance to move the vehicle at a first velocity and to concurrently energize the fly wheel means, and in a second instance, capable of transmitting power stored in the fly wheel to the drive wheel to move the vehicle at a second velocity. In this preferred embodiment, the connecting means would include a flexible connecting member connecting between the motor means and the second body, with the motor means interacting with this flexible connecting member by accumulating the same within the first vehicle.

Preferredly, the velocity governing means would further include a gear train shifting means operatively associated with the second body sensing means and the gear train means. The gear train means would include at least two gear pathways connected to and rotating the drive wheel. One of the pathways would connect the motor means to both the drive wheel and the fly wheel means and the other of the pathways would connect the fly wheel means to the drive wheel. The gear train shifting means would connect one of these pathways and disconnect the other in a first instance when the second body sensing means senses that the second body is in the distal position and would reverse the connection when the sensing means senses that the second body was in the proximal position.

BRIEF DESCRIPTION OF THE DRAWINGS

The invention described in this specification will be better understood when taken in conjunction with the figures wherein.

Figure 1:
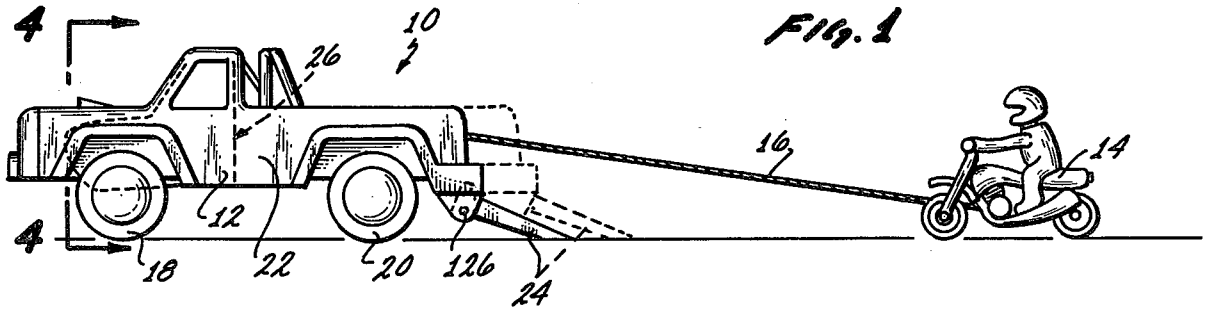
FIG. 1 is a representational side elevational view of a toy incorporating the principles of this invention with a portion of the toy located distal from a second portion of the toy and showing the location of an internal component of the toy in dotted line.

The invention as described in this specification and illustrated in the drawings utilizes certain principles and/or concepts as are set forth in the claims appended to this specification. Those skilled in the toy arts will realize that these principles and/or concepts are capable of being illustrated by a variety of illustrative embodiments differing from the exact illustrative embodiment utilized herein. For this reason this invention is not to be construed as being limited to the illustrative embodiment herein, but is to be construed as only being limited by the claims appended thereto.

DETAILED DESCRIPTION OF THE INVENTION

Prior to describing the mechanical components constituting the illustrative embodiment of this invention, a brief description of the operation of the invention will facilitate further understanding of the mechanical components utilized therein. In FIG. 1, a toy 10 is composed of a first vehicle 12, a second vehicle 14 and a connecting cord 16. The first vehicle 12 includes a set of front driving wheels, collectively identified by the numeral 18, a set of free-wheeling rear wheels, collectively identified by the numeral 20, a truck body, identified by the numeral 22 and a tail gate identified by the numeral 24. The second vehicle 14 is shaped as a motorcycle and, for the illustrative embodiment of the toy 10 utilized for the purposes of this specification, is simply formed as a molded body, including wheels, rider and the like (not separately identified or numbered). The molded parts of the second body 14 are totally non-functional and are for visual purposes only. The second vehicle 14 is of relative little weight, and as such is simply slid along a support surface as herein identified, without the utilization of rotatable wheels and the like. Other embodiments than that illustrative embodiment shown herein could, of course, utilize rotating wheels on the second body 14 if desired.

To operate the toy 10, the person operating the toy simply grasps the first vehicle 12 in one hand, the second vehicle 14 in the other hand, and separates the second vehicle 14 from the first vehicle 12 by pulling the second vehicle 12 away from the first vehicle 12. This elongates the cord 16 and places the second vehicle 14 in a position which is distal to the first vehicle 12, such as is seen in FIG. 1. In so moving the second vehicle 14 away from the first vehicle 12 and elongating the cord 16, a motor as herein identified and described is activated. Upon releasing of both the first and second vehicles 12 and 14, the activated motor causes the first vehicle 12 to be propelled across a support surface at a first velocity. Concurrently, the first vehicle 12 pulls the second vehicle 14 via the cord 16 along with it, and simultaneously, the cord 16 is wound up, or drawn back into, the first vehicle 12, which pulls the second vehicle 14 at a greater velocity than the first vehicle 12, such that the second vehicle 14 overcomes the first vehicle 12.

Figure 2:
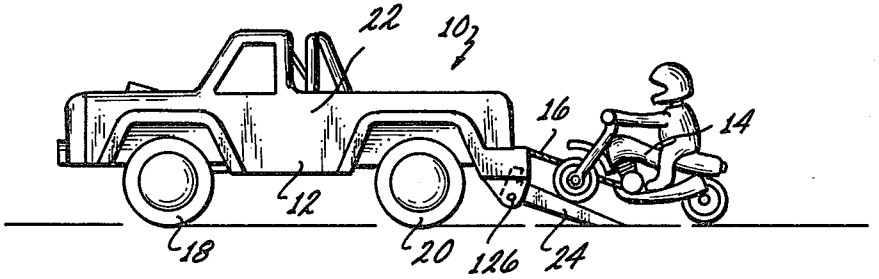
FIG. 2 is a side elevational view similar to FIG. 1, except that the portions of the toy are in a different spatial relationship with respect to one another.

As the second vehicle 14 overcomes the first vehicle 12, it approaches the first vehicle 12, and as seen in FIG. 2, is pulled up on the tail gate 24 of the first vehicle 12 and then into the bed of the body 22 of the first vehicle 12.

Figure 3:
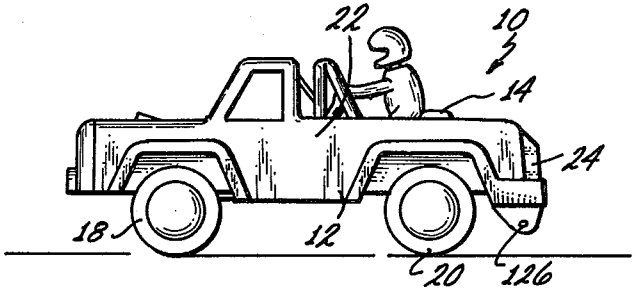
FIG. 3 is a view similar to FIGS. 1 and 2, except that the portions of the toy are in still a different spatial relationship to one another.
Figure 4:
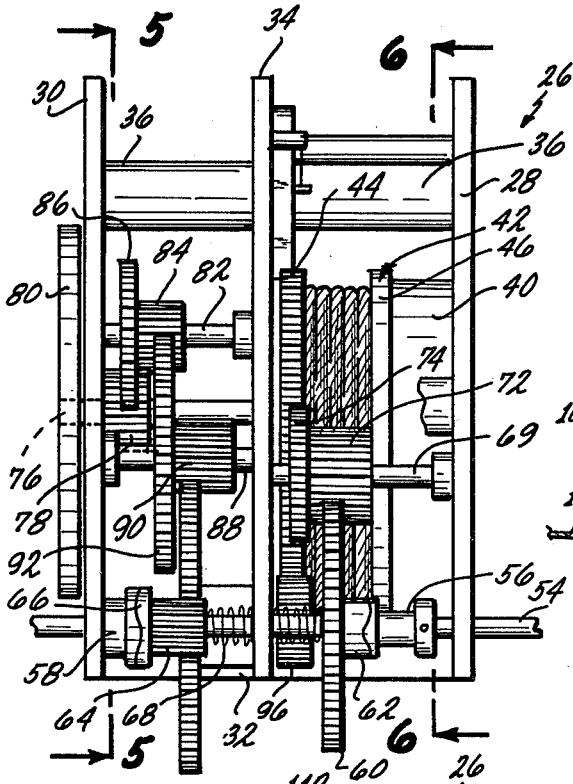
FIG. 4 is an end elevational view about the line 4—4 of FIG. 1 with regard to those parts shown in dotted line in FIG. 1.

When the second vehicle 14 is in a position proximal to the first vehicle 12, and in fact is within the confines of the body 22, the second vehicle 14 trips a mechanism, as hereinafter described, which results in lifting of the tail gate 24 into the position seen in FIG. 3 and a change in the velocity in the first vehicle 12 from that of its original slower velocity to a faster velocity. The first vehicle 12, with the second vehicle 14 located thereon, now proceeds across the support surface at this higher velocity until the driving mechanism, as hereinafter illustrated and explained, within the first vehicle 12 is de-energized and the totality of the toy 10 comes to rest. The toy 10 is now ready to repeat the cycle by once again withdrawing the second vehicle 14 from the first vehicle 12 and energizing the toy 10.

Figure 5:
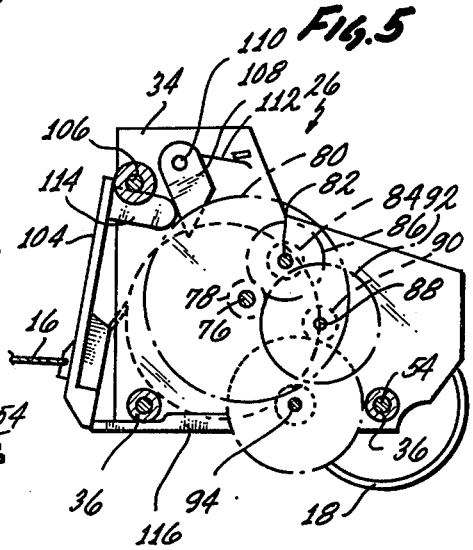
FIG. 5 is a side elevational view about the line 5—5 of FIG. 4.
Figure 6:
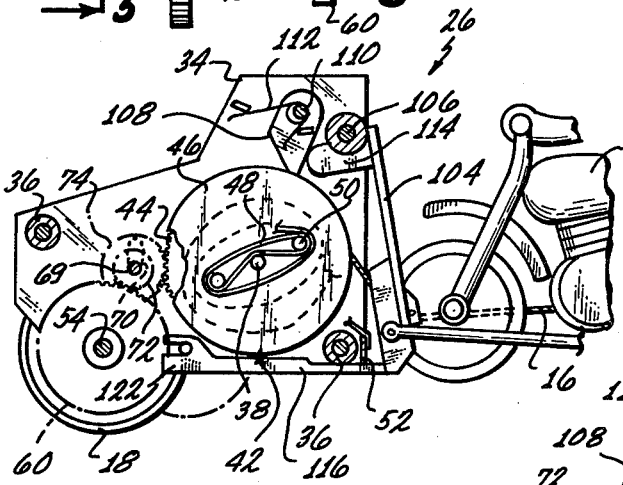
FIG. 6 is a side elevational view about the line 6—6 of FIG. 4 and further including additional components in the spatial relationship shown in FIG. 3.
Figure 7:
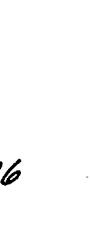
FIG. 7 is a view similar to FIG. 6 with the exception that certain of the components are in a different spatial relationship with respect to one another.
Figure 7:
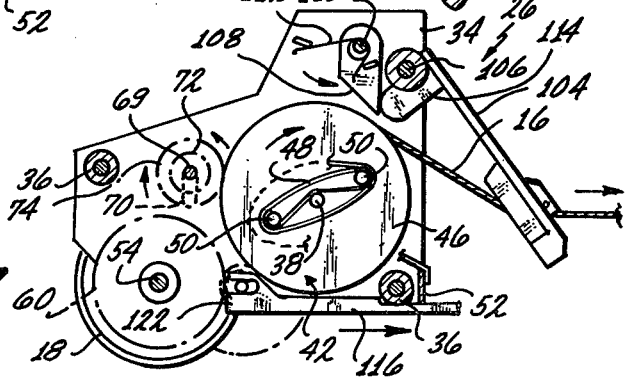
Figure 8:
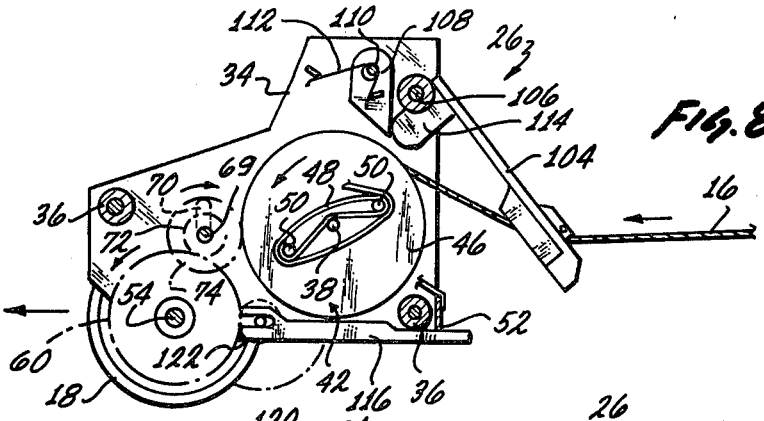
FIG. 8 is a Figure similar to FIG. 6 except that certain of the components are in a further different spatial relationship with respect to one another.

Referring now to FIGS. 4 through 10 of the drawings, the internal components of the first vehicle 12 are illustrated. FIG. 6 shows the arrangement wherein the second vehicle 14 is located on the first vehicle 12 and is being carried by it. FIG. 7 illustrates certain components as they are while the second vehicle 14 is being pulled away from the first vehicle 12 to activate the toy 10. FIG. 8 shows these same components after the second vehicle 14 has been released and is being drawn back to the first vehicle 12. FIG. 5 is a view of the other side of FIGS. 6, 7 and 8, showing how certain gears, later identified, intermesh and the like.

The power and control unit 26 fits within the first vehicle 12 as is indicated by the dotted lines in FIG. 1. This unit 26 has two side housing components 28 and 30, and a bottom housing component 32. Additionally, there is a central housing component 34 located about midway between the two side components 28 and 30, and a plurality of cross members, collectively identified by the numeral 36, which, in conjunction with the bottom housing 32, maintain the side components in their respective position and fixedly hold the power and control unit as a unit. The unit 26 is appropriately mounted by screws and the like to the body 22 of the first vehicle 12.

The side housings 28 and 30, as well as the central housing 34, contain a plurality of drillings and hollow bosses, not identified or numbered, which serve as bearing surfaces for appropriate axles and the like, as herein identified. Mounting of the individual axles and the like will therefore not be discussed in great detail.

An axle 38 is appropriately supported in housing 28 and 34. A large circular boss 40 is formed on the inside surface of the side housing 28. The boss 40 is hollow and is open on the side toward the central housing 34. Mounted next to the boss 40 about axle 38 is a spool 42. One of the edges of the spool 42 is formed as a gear 44. The other of the edges is formed as a flange 46. The gear 44 and flange 46 serve as edges such that the cord 16 can be wound about the spool 42.

One end of the cord 16 is fixedly attached to the second vehicle 14 and the other end is fixedly attached to the spool 42. As such, movement of the cord 16 is transferred into rotation of the spool 42 and vice versa.

Coiled inside of the boss 40 is a flat coil spring 48. One end of the spring 48 passes around two bosses 50, which are formed on the outside of the flange 46 and project inwardly within the interior of the boss 40. The other end of the spring 48 is hooked to a cross member 52 projecting between side housing 28 and central housing 34. The attachment to cross member 52 anchors one end of the coil spring 48 to the power and control unit 26, while winding of the other end of the spring 48 about the bosses 50 attach the other end of the spring 48 to the spool 42. The spring 48 is wound about within the interior of the boss 50 and the cord 16 is attached to the spool 42 such that movement of the cord 16 in a direction away from the power and control unit 26 causes clockwise rotation of the spool 42, as viewed in FIGS. 6, 7 and 8, which in turn causes or creates a bias in the spring 48. Once the cord 16 is totally withdrawn from the power and control unit 26, with the second vehicle 14 located in a distal position with respect to the first vehicle 12, the spring 48 is at its maximum tension. By increasing the second vehicle 14, which in turn releases the cord 16, the tension within the spring 48 then rewinds the cord 16 on the spool 42, rotating the spool 42 counterclockwise, as viewed in FIGS. 6, 7 and 8.

An axle 54 serves as the front axle for the first vehicle 12. The drive wheels 18 are fixedly mounted to the axle 54 and thus the axle 54 and the drive wheels 16 rotate in unison.

A bushing 56, having a convoluted surface on one of its ends, is fixedly mounted to axle 54 near side housing 28. A similar bushing 58 is fixed to axle 54 near side housing 30. A gear 60, having a bushing 62 located on its side, is freely located about axle 54. The bushing 62 interacts with the bushing 56 to form a clutch mechanism between gear 60 and the axle 54. A second gear, pinion gear 64, having a bushing 66 located on its side, likewise is free-wheeling about axle 54, but in combination with the bushing 58, the bushing 66 serves as a clutch mechanism to communicate rotation of the pinion 64 to the axle 54. A spring 68 passes through an appropriate opening in the central housing 34, allowing the spring 68 to push against both the gear 60 and the pinion 54, which in turn pushes the bushing 66 against the bushing 58 and the bushing 62 against the bushing 56 to complete the two clutch mechanisms.

The pinion 64 will slip with respect to the axle 54 by compression of the spring 48 toward the gear 60 and the gear 60 will slip with respect to the axle 54 by compression of the spring 48 toward the pinion 64.

An axle 69 is appropriately mounted in two slots, one of which is located in the side housing 28 and the other in the central housing 34. The one of these slots 70 formed in the side housing 28 can be seen in FIG. 6. The other of the slots is not shown in the Fig., however, it would be indentical to the slot 70 seen in the housing 28 but would simply be located in the central housing 34. In any event, axle 69 is free to move up and down in these slots. Axle 69 carries a compound gear thereon which includes a pinion 72 and a spur gear 74. The pinion 72 can mesh with gear 60, which, it will be remembered, was mounted about axle 54, and the spur gear 74 can mesh with the gear 44 on the spool 42. If the gear 44 on the spool 42 is rotating counterclockwise, as seen in FIGS. 6, 7 and 8, the counterclockwise rotation of the gear 44 causes the gear 44 to mesh with the spur gear 74, depressing the axle 69 downward in the slots 70 such that the pinion 72 meshes with the gear 60. Thus, upon counterclockwise rotation of the gear 44 under the influence of the bias in spring 48 when it is wound tight results in clockwise rotation of both the pinion 72 and the spur gear 74 which are attached together, and counterclockwise rotation of the gear 60, which in turn, rotates the axle 54 counterclockwise, and the drive wheels 18 counterclockwise. This will propel the toy 10 in a direction toward the left as viewed in FIGS. 6, 7 and 8.

When the gear 44 is rotated clockwise as viewed in FIGS. 6, 7 and 8 however, the clockwise rotation of the gear 44 tends to lift the pinion 72 and spur gear 74 upwardly, such that their axles 68 rides up in the slots 70, which breaks the contact between the pinion 72 and the gear 60 and thus the clockwise rotation of the gear 44 is not communicated to the gear 60.

If the gear 44 is fixedly held as hereinafter described, but the drive wheel 18 is being rotated counterclockwise as seen in FIG. 7, as for instance, if the child utilizing the toy 10 was simply pushing the toy 10 along a surface, the counterclockwise movement of the gear 60 with no accompanying counterclockwise movement of the gear 44, would cause the pinion 72 and spur gear 74 to lift their axle 68 up in the slots 70, breaking the connection between the pinion 72 and the gear 60, allowing for free-wheeling of the first vehicle 12 in a forward direction across a support surface. If the gear 44 is fixedly held as hereinafter explained, and the first vehicle 12 is moved backwards as viewed in FIGS. 6, 7 and 8, such that the gear 60 would be turning clockwise, the pinion 72 and spur gear 74 would be forced into engagement with the respective gears 60 and 44, with the axle 68 found in the lower portion of the slot 70, and this would lock the gear 60. However, because of the clutch action between the bushings 56 and 62, the axle 54 would be allowed to slip with respect to the gear 60 by compression of the spring 48.

An axle 76 traverses between side housing 30 and central housing 34. A pinion 78 is fixedly located on axle 76 in the area between the two housing members. A fly wheel 80 is also fixedly mounted to the axle 76. However, it is on the outside of the housing 30. Thus, both the fly wheel 80 and the pinion 78 rotate in conjunction with rotation of the axle 76.

An axle 82 traverses between the side housing 30 and the central housing 34. It carries on it a pinion 84 and a spur gear 86, both of which are fixed to the axle 82 and rotate in conjunction with it. The spur gear 86 meshes with the pinion 78, which, as noted above, is connected to the fly wheel 80.

An axle 88 extends between the side housing 30 and the central housing 34 and carries on it a pinion 90 and a spur gear 92. The spur gear 92 meshes with the pinion 84. Thus there is a continuous drive train of gears between pinion 90 and the fly wheel 80.

Figure 9:
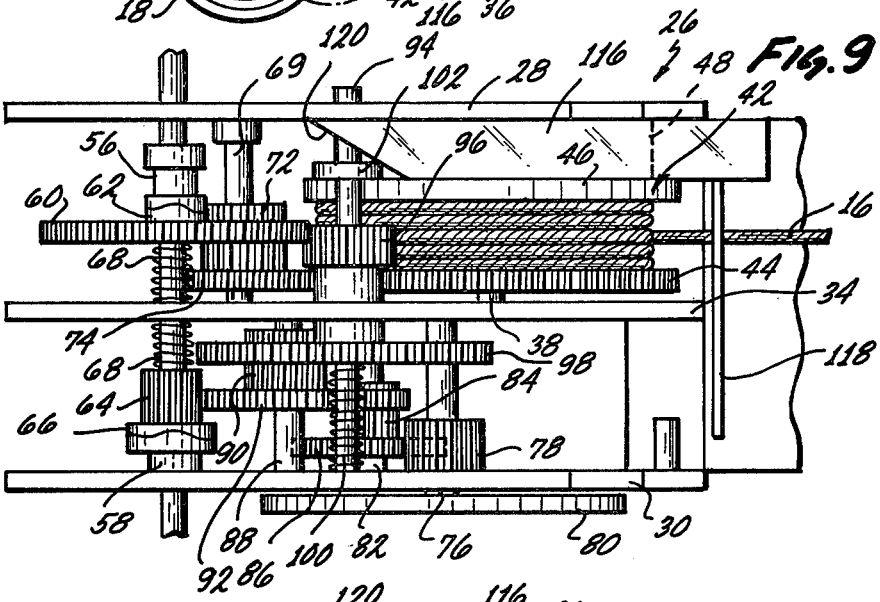
FIG. 9 is a bottom plan view of the components illustrated in FIG. 4 with certain of these components in a first spatial relationship.
Figure 10:
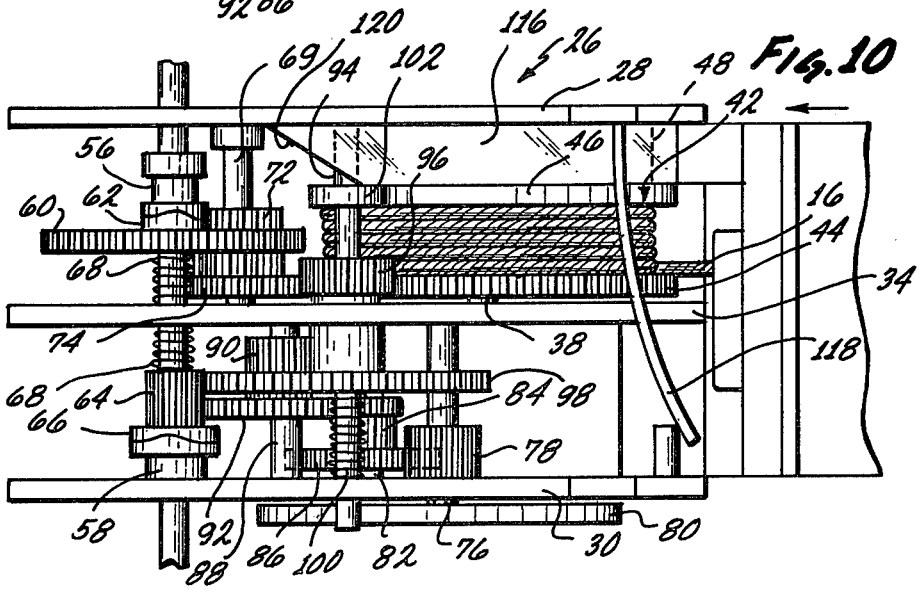
FIG. 10 is a bottom plan view similar to FIG. 9 except that certain of the components are in a different spatial relationship than as illustrated in FIG. 9.

An axle 94 is slidably mounted in all of the housing components 28, 30 and 34. The axle 94 carries a pinion 96 fixedly mounted to it. In between the housing components 30 and 34, the axle 94 carries on it a spur gear 98, which is also fixed to the axle 94 and rotates in conjunction with it. Thus, spur gear 98 and pinion 96 rotate with respect to one another. A spring 100 is positioned between spur gear 98 and housing component 30 which biases the spur gear 98 away from the housing component 30 towards the housing component 34, and in doing so, slides the axle 94 in a direction toward the housing component 28. The axle 94 also carries a bushing 102 fixedly located on it, which, when interacted upon as indicated below, in conjunction with the spring 100, serves to position the axle 94 and the components located thereon between a first position as seen in FIG. 9, and a second position as seen FIGS. 10 and 4.

When the axle 94 is in the first position, the pinion 96 meshes with the gear 60, and as such, the pinion 96, the axle 94 and the spur gear 98 located thereon, rotate in conjunction with rotation of the gear 60. Spur gear 98 is in continuous intermesh with pinion 90, and thus, when the axle 94 is in the first position, the rotation of the gear 60 is transferred through pinion 96, to spur gear 98 to pinion 90, which in turn, as pointed out above, ultimately transfers rotation to and rotates the fly wheel 80.

When the axle 94 is in the second position, the pinion 96 disengages with the spur gear 60 and the spur gear 98 engages with the pinion 64 located on the axle 54. In this configuration, energy stored in fly wheel 80, if the same is rotated, can be transferred via the pinion 90 to the spur gear 98 and from there to the pinion 64 to rotate the axle 54 and the drive wheel 18 attached thereto.

A plate 104 is hinged to the housing components 28 and 30 about an axle 106. The cord 16 passes through an opening in the plate 104. A ratchet 108 is hinged to central housing 34 via an axle 110. A hairpin spring 112 biases the ratchet 108 to the right in FIGS. 6, 7 and 8, and to the left in FIG. 5. The bias immparted to the ratchet 108 in turn, by contact of the ratchet 108 against the extension 114 on the plate 104, biases the plate 104 counterclockwise about its axle 106 as seen in FIGS. 5, 6 and 7, and clockwise as seen in FIG. 8.

A sliding member 116 is biased by a spring 118 backward towards the plate 104. The sliding member 116 includes a wedge-shaped surface 120 on it, which is positioned to interact with the bushing 102 on the axle 94. The wedge-shaped surface 120 is located on the inside surface of the projection 122 of the sliding member 116. The projection 122 can be seen in FIGS. 6, 7 and 8. The projection 122 forms the bottom half of the end of sliding member 116 with the top half (not separately numbered or identified) located on the top of the axle 104. This "U" shape on the edge of the sliding member 116 keeps it centered about the axle 94.

When the second vehicle 14 is located in a position proximal to the power control unit 26 the front of second vehicle 14 contacts the plate 104 and pivots it inwardly toward the remainder of the components of the unit 26. This causes the extension 114 to contact the ratchet 108, which moves the ratchet 108 in a clockwise direction as seen in FIGS. 6, 7 and 8, such that the ratchet 108 engages the gear 44 on the spool 42 and fixedly holds the spool 42 against further rotation. Also at this time, the wedge-shaped surface 120 on the projection 122 engages the bushing 102 and slides the sliding axle 94 and pinion 96 and spur gear 98 located thereon to the second position seen in FIGS. 10 and 4. When the second vehicle 14 is not in the proximal position, but is moved somewhere away from the power and control unit 26, the second vehicle 14 no longer engages the plate 104 and under the bias of both the spring 112 on the ratchet 108 and the spring 118 on the sliding member 116, the ratchet 108 rotates clockwise to disengage with the gear 44 and the sliding member 116 slides towards the rear of the power and control unit 26, allowing the bushing 102 to slide against the wedge-shaped surface 120, which in turn allows the axle 94 and the pinion 96 and spur gear 98 attached thereto to move to the first position as seen in FIG. 9.

In utilizing the toy 10, as noted earlier, the second vehicle 14 is first pulled away from the first vehicle 12. This is illustrated in FIG. 7. As this happens, the plate 104 rotates counterclockwise as seen in FIG. 7, allowing the ratchet 108 to disengage the gear 44 and plate 104 to slide backwardly, positioning the axle 94 and the components attached thereto in their first position as seen in FIG. 9.

When the second vehicle 14 is fully extended away from the first vehicle 12 with all of the cord 16 wound off of the spool 42, the components noted in the previous paragraph remain in the position as noted. However, at this time, the spring 48 has been fully wound and thus the vehicle 12 is energized. Further in reference to FIG. 7, it can be seen that the compound gear composed of the pinion 72 and the spur gear 74 has disengaged with the gear 60, such that during winding or tensing of the spring 48, no motion is communicated to the gear 60, which in turn results in no rotation of the axle 54, which subsequently in turn results in no rotation of any other of the gear train as previously described.

When the second vehicle 14 is in a distal position and the cord 16 has been fully extended, and the second vehicle 14 is released, the spring 48 causes winding of the spool 42 in a counterclockwise direction as viewed in FIG. 8, which accumulates the cord 16 about the spool 42. In so doing, the gear 44 is turned counterclockwise as viewed in FIG. 8 which causes engagement of the spur gear 74 against the gear 44 and engagement of the pinion 72 against the gear 60, causing rotation of the axle 54 which drives the first vehicle 12 forward at a first velocity and concurrently rotates the fly wheel 80, energizing the same.

When the cord 16 has been fully accumulated on to the spool 42, such that the second vehicle 14 is located on the first vehicle 12 and the second vehicle 14 engages the plate 104, the engagement of the second vehicle 14 against the plate 104 rotates the plate 104 counterclockwise as seen in FIG. 6, which in turn causes engagement of the ratchet 108 against the rear 44, locking the gear 44. Also, movement of the plate 104 counterclockwise causes engagement of the plate 104 against the sliding member 116, sliding the sliding member 116 forward, causing the wedge-shaped surface 120 to engage the bushing 102 to move the axle 94 to its second position shown in FIGS. 9 and 4. As soon as the axle 94 is moved into its second position, pinion 96 disengages gear 60 and spur gear 98 engages pinion 64 as noted above, which allows for the energy stored in the fly wheel 80 to now be transferred to the axle 54 to continue rotating the drive wheels 18. However, because of the gearing, the rotation of the axle 54 is at a different speed under the influence of the fly wheel 80 that it was under the direct influence of the gear 44 and the first vehicle moves at a more rapid velocity across the support surface until all of the energy stored in the fly wheel 80 is lost and the toy 10 comes to rest.

The locking of the gear 44 by the ratchet 108 when the second vehicle engages the plate 104 ensures that the gear 44 is fixedly held, and thus, when the first vehicle 12 is moving forward under the energy stored in the fly wheel 80, the gear composed of the pinion 72 and the spur gear 74 moves upwardly and breaks the contact between the gear 60 and the gear 44, allowing for disengagement of the gear 44 from the drive train.

The clutches composed of the bushings 58 and 66 and 56 and 62 allow for rotation of the drive wheels 18 both backward and forward. This is designed to prevent damage to the toy 10 in instances where the toy 10 is pushed backwards by hand across a support surface with the gear 44 locked by the ratchet 108; where the user of the toy 10 inappropriately rotates the drive wheels 18 in one direction or the other, concurrently pulling the second vehicle 14 away from the first vehicle 12; where the fingers of the user of the toy 10 are held against the plate 104 causing the gear train to be shifted into the second position, or the like events.

As seen in FIG. 6, the tail gate 24 is connected to the plate 104 via a member 124. The tail gate 24 is hinged to the body 22 via an axle 126 and the connection via the member 124 is such that the tail gate 24 moves in unison with the plate 104, the tail gate 24 being raised when the plate 104 is forward as it is when the second vehicle 14 is located against it, and being lowered when the plate 104 is moved rearwardly as it is when it is released by moving the second vehicle 14 backwardly from its proximal position to its distal position.

As will be appreciated from the construction described herein, when the axle 94 is in the second position such that axle 54 is linked to the fly wheel 80, which of course occurs when the second vehicle 14 is located on the first vehicle 12, the toy 10 is capable of functioning as an inertia powered toy. The user of the toy 10 simply pushes the toy 10 across a support surface, which rotates the drive wheels 18 and transfers this rotation to the fly wheel 80 to energize the same. With the fly wheel 80 energized, the release of the toy 10 by the user is followed by movement of the toy 10 across a support surface under the energy stored in the fly wheel 80.

I claim:

1. A toy which comprises:

a first body;

said first body including a spring activated motor means;

said first body including a variable velocity moving means operatively associated with and receiving power from said motor means and capable of moving said first body at at least two velocities with respect to the support medium;

a second body associated with said first body;

a connecting means fixedly attached to said second body and movably associated with said first body motor means whereby movement of said second body away from said first body from a proximal position to a distal position moves said connecting means with respect to said motor means activating said motor means, and when so activated said motor means interacting with said connecting means and in response to said movement of said connecting means and said second body being moved from said distal position towards said first body to said proximal position;

velocity governing means operatively associated with said moving means and operatively responsive to the position of said second body with respect to said first body whereby (a) after said second body has been moved from said proximal position away from said first body to said distal position, said moving means in association with said governing means moving said first body at one of said velocities;

(b) moving said first body at the second of said two velocities as a result of said 2nd body being moved from said distal to said proximal portion.

2. The toy of claim 1 wherein:

when said second body is in said proximal position, said first body capable of holding said second body and transporting said second body in conjunction with movement of said first body with respect to said support medium.

3. The toy of claim 2 wherein:

said moving means includes a fly wheel means capable of being energized as said first body moves at said one of said velocities and when so energized moving said first body at said second velocity.

4. The toy of claim 3 wherein:

said velocity governing means includes second body sensing means located on said first body and capable of sensing when said second body is in said distal position and when said second body is in said proximal position.

5. The toy of claim 4 wherein:

said first body comprises a first vehicle and said moving means includes at least one drive wheel located on said first vehicle.

6. The toy of claim 5 wherein:

said moving means includes gear train means associated with said drive wheel, said motor means and said fly wheel means;

said gear train means capable of propagating power from said motor means to both of said drive wheel and said fly wheel means to move said vehicle at said first velocity and to energize said fly wheel means and further capable of transmitting power stored in said fly wheel means to said drive wheel to move said first vehicle at said second velocity.

7. The toy of claim 6 wherein:

said connecting means includes a flexible connecting member, said motor means interacting with said flexible connecting member by accumulating said connecting member with said first vehicle.

8. The toy of claim 7 wherein:

said velocity governing means further includes gear train shifting means, said gear train shifting means operatively associated with both said second body sensing means and said gear train means;

said gear train means including at least two gear pathways connecting to and capable of rotating said drive wheel, one of said pathways connecting said motor means to both said drive wheel and said fly wheel means and the other of said pathways connecting said fly wheel means to drive said wheel;

said gear train shifting means connecting said one of said pathways and disconnecting the other of said pathways with said drive wheel when said second body sensing means senses that said second body is in said distal position and connects the other of said pathways and disconnects said one of said pathways with said drive wheel means when said second body sensing means senses that said second body is in said proximal position.

9. The toy of claim 1 wherein:

said second velocity is greater than said first velocity.

* * * * *